United States Patent [19]

Kinnear

[11] Patent Number: 4,745,635

[45] Date of Patent: May 24, 1988

[54] DISPOSABLE GLOVE OR MITT FOR SELF-SERVICE GASOLINE

[76] Inventor: Duane W. Kinnear, R.D. #1, 11770 Ridge Rd., East Springfield, Pa. 16411

[21] Appl. No.: 937,886

[22] Filed: Dec. 4, 1986

[51] Int. Cl.[4] ..... A41D 19/00

[52] U.S. Cl. ..... 2/161 R; 2/163; 2/167

[58] Field of Search ..... 2/167, 163, 161; 428/166, 178; 206/4, 522

[56] References Cited

U.S. PATENT DOCUMENTS

| | | | |
|---|---|---|---|
| 3,142,599 | 7/1964 | Chavannes | 206/522 X |
| 3,235,881 | 2/1966 | Chisholm | 2/167 |
| 4,096,306 | 6/1978 | Carson | 428/166 |
| 4,287,250 | 9/1981 | Rudy | 206/522 X |

FOREIGN PATENT DOCUMENTS

| | | | |
|---|---|---|---|
| 333946 | 7/1903 | France | 2/161 R |
| 1585083 | 1/1970 | France | 206/522 |
| 2415943 | 9/1979 | France | 206/522 |

*Primary Examiner*—Werner H. Schroeder
*Attorney, Agent, or Firm*—Ralph Hammar

[57] ABSTRACT

A glove made of blister pack material to be worn for self-service gasoline.

5 Claims, 1 Drawing Sheet

DISPOSABLE GLOVE OR MITT FOR SELF-SERVICE GASOLINE

This invention is a glove or mitt to be worn while pumping self-service gasoline which provides a good gripping surface for the cold metal parts, insulates the hands from the metal parts and prevents contact with gasoline which has an objectionable odor.

In the prior art, gloves or mitts have been made in which two identical pieces of plastic film are placed one on top of the other and heat sealed together at peripheral edges. If the plastic film is perfectly smooth or flat difficulty has been experienced in putting the gloves on because the adjacent surfaces tend to cling together.

In accordance with the present invention, at least the palm side of the glove or mitt is a commercially available plastic laminate known as "blister pack" consisting essentially of a sheet of load carrying plastic bubbles of trapped air. Other names for this material are Bubble Pak, Vista Flex. Sheets of blister pack have been used to absorb shock in shipping.

Figure 1:
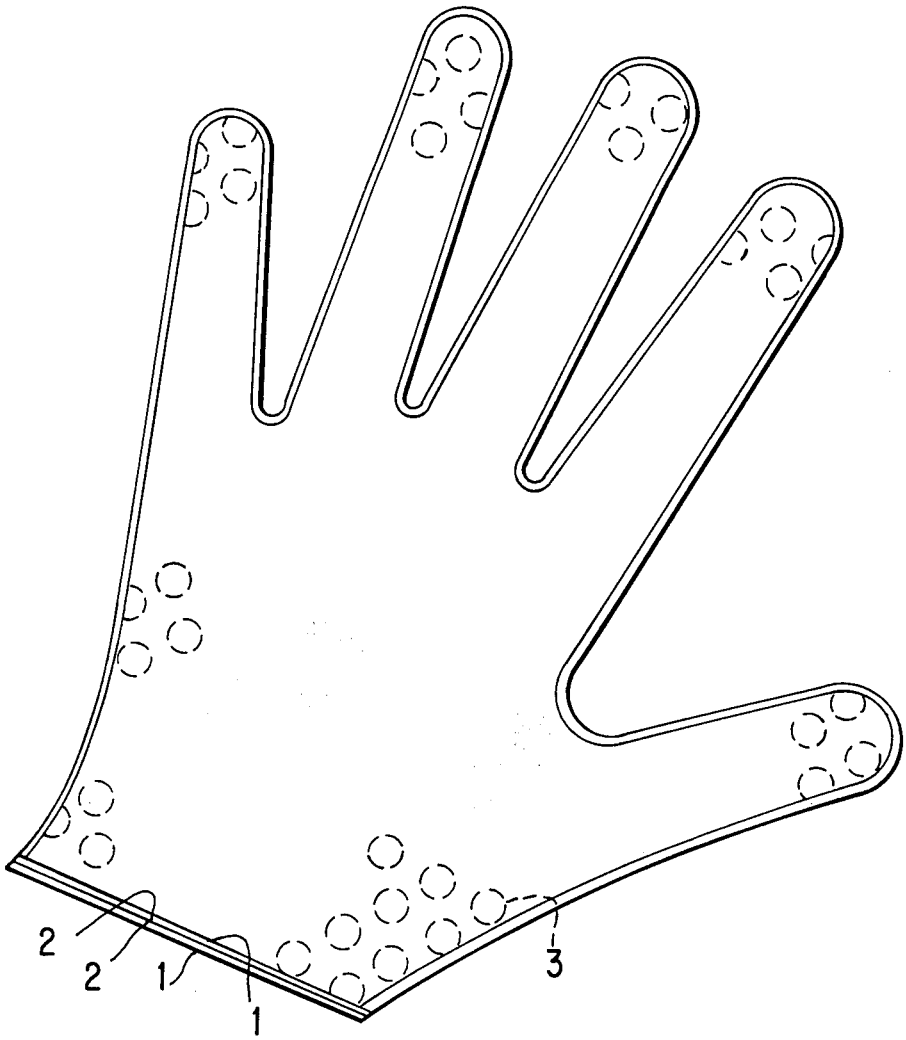
FIG. 1 is a view of a disposable glove.
Figure 2:
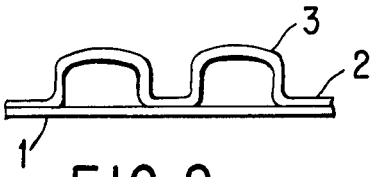
FIG. 2 is a sectional view of blister pack laminate.

FIG. 1 shows the invention applied to a common glove shape for self-service gasoline but obviously any other shape could be used. Both the front and back sides of the glove (palm and back) are made from blister pack laminate of polyethylene or other tough flexible plastic. In the laminate, the layer 1 is plain or smooth. The other layer 2 has distributed indentations 3 which when bonded to the layer 1 provide distributed bubbles or blisters of trapped air which provide a cushion strip. The diameter of the bubbles is much less than finger width, as is clearly shown in the drawing. The laminating process causes the plain sheet 1 of plastic to lose its perfectly smooth surface so that when two of the smooth sheets come into contact with each other they do not cling together. The glove is easy to put on when the bubbles or blisters are on the inner surface of the glove. The glove is very comfortable for self-service gasoline. The bubbles provide a cushion grip for the dispensing nozzle and thermal insulation from the cold metal parts of the nozzle.

When the blisters are on the inner surfaces of the glove, the areas between the blisters are part of the insulation. If the blisters were on an outer surface of the glove, cold air could flow freely in the area around the blisters and about half of the insulating qualities would be lost. An extra layer of plastic on the inside of the glove still further increases the insulating properties.

U.S. Pat. No. 4,084,265 is directed to the problem of preventing sticking together of films of plastic and does not contemplate a plastic film laminate with distributed bubbles of trapped air over at least one surface of the laminate.

The blisters or bubbles of the blister pack laminate do not interfere with heat sealing whether the heat sealing is between a blister pack sheet and a plain sheet or between two blister pack sheets. During heat sealing, some of the bubbles which fall along the line of the seal may be broken but the cushioning or heat insulating properties are not materially affected.

Since the glove may be worn on either hand, it is not necessary to buy a pair of gloves (right and left).

A glove in which the palm side is of blister pak and the back side is of a sheet of bubble free plastic would not absorb gasoline and would be impervious to gasoline but would feel very cold on back of hand.

All forms of the glove are inexpensive to manufacture. The gloves are made from low cost plastic sheets which are assembled by heat sealing.

I claim:

1. A glove or mitt to be worn for self-service gasoline having a palm side of blister pack of flexible plastic film, the blisters being on the inner surface of the glove and of diameter much less than finger width and containing trapped air which provides a cushioned gripping surface and shock and thermal insulation.

2. A glove or mitt to be worn for self-service gasoline having a palm side of a sheet of bubbles of flexible plastic, the bubbles being on the inner surface of the glove and of diameter much less than finger width and filled with air.

3. The glove of claim 1 in which the palm and back sides are of blister pack material.

4. The glove of claim 2 in which the palm and back sides are each of a sheet of bubbles of flexible plastic, the bubbles being filled with air.

5. A glove or mitt to be worn for self-service gasoline having a palm side of a sheet of bubbles of flexible plastic, the bubbles being on the inner surface of the glove and of diameter much less than finger width and filled with air and a back side of a sheet of plastic without bubbles.

* * * * *